US008310402B2

(12) United States Patent
Yang

(10) Patent No.: US 8,310,402 B2
(45) Date of Patent: Nov. 13, 2012

(54) COMPACT MULTI-ELEMENT ANTENNA WITH PHASE SHIFT

(75) Inventor: Xiao Ping Yang, San Diego, CA (US)

(73) Assignee: Airgain, Inc., Carlsbad, CA (US)

( * ) Notice: Subject to any disclaimer, the term of this patent is extended or adjusted under 35 U.S.C. 154(b) by 0 days.

(21) Appl. No.: 13/329,895

(22) Filed: Dec. 19, 2011

(65) Prior Publication Data

US 2012/0086604 A1 Apr. 12, 2012

Related U.S. Application Data

(63) Continuation of application No. 11/866,354, filed on Oct. 2, 2007, now Pat. No. 8,081,123.

(60) Provisional application No. 60/827,846, filed on Oct. 2, 2006.

(51) Int. Cl.
*H01Q 1/24* (2006.01)

(52) U.S. Cl. ..... 343/702; 343/700 MS

(58) Field of Classification Search ..... 343/700 MS, 343/702, 876, 893
See application file for complete search history.

(56) References Cited

U.S. PATENT DOCUMENTS

| | | | | |
|---|---|---|---|---|
| 5,598,174 | A * | 1/1997 | Erkocevic et al. | 343/795 |
| 6,005,530 | A * | 12/1999 | Jovanovich et al. | 343/827 |
| 6,222,494 | B1 * | 4/2001 | Erkocevic | 343/790 |
| 6,456,257 | B1 * | 9/2002 | Zamat | 343/876 |
| 6,512,487 | B1 * | 1/2003 | Taylor et al. | 343/795 |
| 2003/0132890 | A1 * | 7/2003 | Rawnick et al. | 343/824 |
| 2003/0189518 | A1 * | 10/2003 | Johnson et al. | 343/702 |
| 2004/0125036 | A1 * | 7/2004 | Chiang et al. | 343/757 |
| 2005/0200538 | A1 * | 9/2005 | Tran | 343/702 |

* cited by examiner

*Primary Examiner* — Hoanganh Le
(74) *Attorney, Agent, or Firm* — Clause Eight IPS; Michael Catania

(57) ABSTRACT

A phased array antenna system includes a first radiation element that is made of a material and has a length selected to resonate at a desired frequency. A phase-shift element is coupled to one end of the first radiation element. A second radiation element is coupled to the end of the phase-shift element opposite the first radiation element, so that a radio signal passes through the first radiation element through the phase-shift element and through the second radiation element, the second radiation element is made of a material and has a length selected to resonate such that the first and second radiation elements cooperate to form a desired beam pattern from the antenna system.

14 Claims, 10 Drawing Sheets

COMPACT MULTI-ELEMENT ANTENNA WITH PHASE SHIFT

CROSS REFERENCE TO RELATED APPLICATION

The present application is a continuation application of U.S. patent application Ser. No. 11/866,354, filed on Oct. 2, 2007, now U.S. Pat. No. 8,081,123 which claims the benefit of U.S. Provisional Patent application No. 60/827,846, filed Oct. 2, 2006, both of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

This invention relates to wireless communication systems, and in particular, to directional antennas used in such systems.

2. Description of the Related Art

In wireless communication systems, antennas are used to transmit and receive radio frequency signals. In general, the antennas can be omni-directional or directional. In many applications there is a benefit to having the antenna located within an enclosure or case which encloses a device that uses the antenna. However, placing an antenna within the enclosure and in close proximity to the components of the device, can greatly decrease the performance of the antenna.

Thus, there is a need for improved performance for antennas placed within enclosures.

BRIEF SUMMARY OF THE INVENTION

Methods, apparatuses, and systems are described for antenna systems that can be contained within an enclosure of a device which uses the antenna while providing positive gain. In one aspect the antenna system includes an array of antenna elements which cooperate to form an antenna beam pattern. The antenna elements can be arranged as two or more in-phase antenna elements which cooperate to increase the gain of the antenna system in a desired beam pattern. Using more than one antenna element can increase the length of the overall antenna system which can decrease the negative effects of other elements of the system in the enclosure by limiting those negative effects to a relatively smaller portion of the antenna system. This increases the robustness and tolerance of the antenna system, and allows antennas to be embedded in an enclosure with a printed circuit board assembly (PCBA) or on-board assembly easily. In one aspect, two or more of the antenna systems are used to provide different antenna patterns simultaneously of selectively.

In one embodiment, a phased array antenna system includes a first radiation element that is made of a material and has a length selected to resonate at a desired frequency. A phase-shift element, such as a delay element, is coupled to one end of the first radiation element. A second radiation element is coupled to the end of the phase-shift element opposite the first radiation element, so that a radio signal passes through the first radiation element through the phase-shift element and through the second radiation element, the second radiation element is made of a material and has a length selected to resonate such that the first and second radiation elements cooperate to form a desired beam patter from the antenna system.

In this embodiment, the first radiation element can be a length that is approximately one-quarter a wavelength of the radio signal, and the second radiation element is a length that is approximately one-half a wavelength of the radio signal. The phase-shift element shifts the phase of the radio signal approximately one-half a wavelength of the radio signal. In addition, the antenna can include a switch such that operation of the switch disconnects the second radiation element from the first radiation element. The first and second radiation elements can also include components that can be switched on or off and vary the frequency that the elements resonate at.

In another embodiment, a phased array antenna system includes a lower radiating element comprising a dipole section and an H section that cooperate to act as a radiating element. In one embodiment, the dipole section and the H section cooperate to act as a dipole antenna. A phase-shift element is coupled to the lower radiating element. A terminal radiating element is coupled to the phase-shift element opposite to the lower radiating element, the terminal radiating element and the lower radiating element cooperate to form a desired antenna pattern.

The antenna system can also include a switch between the lower radiating element and the phase-shift element, where operation of the switch couples and de-couples the lower radiating element to the phase-shift element and the terminal element. There can also be a switch in the phase-shift element, where operation of the switch changes an amount of phase-shift introduced by the phase-shift element.

In another embodiment, a circuit board, such as a printed wiring board or a substrate or a carrier, includes a first radiation element that is made of a material and has a length selected to resonate at a desired frequency. The circuit board also includes a first phase-shift element coupled to one end of the first radiation element. There is a second radiation element coupled to the end of the phase-shift element opposite the first radiation element, so that a radio signal passes through the first radiation element through the phase-shift element and through the second radiation element, the second radiation element is made of a material and has a length selected to resonate such that the first and second radiation elements cooperate to form a desired beam patter from the antenna system.

The circuit board can also include a second phase-shift element coupled to the one end of the second radiation element opposite the first phase-shift element; and a third radiation element coupled to the end of the second phase-shift element opposite the second radiation element. A radio signal can pass through the first radiation element through the first phase-shift element through the second radiation element through the second phase-shift element and through the third radiation element, the third radiation element is made of a material and has a length selected to resonate such that the first, second, and third radiation elements cooperate to form a desired beam patter from the antenna system. In other embodiments, any desired number of radiation elements and phase-shift elements can be used in an antenna system In yet another embodiment, a circuit board includes a first side with a first antenna system and a second side with a second antenna system, wherein the two antenna systems operate at different frequencies. For example, on the first side of the card there is a first radiation element that is made of a material and has a length selected to resonate at a first desired frequency, a first phase-shift element coupled to one end of the first radiation element, and a second radiation element coupled to the end of the phase-shift element opposite the first radiation element, so that a radio signal passes through the first radiation element through the phase-shift element and through the second radiation element, the second radiation element is made of a material and has a length selected to resonate such that the first and second radiation elements cooperate to form a desired beam patter from the antenna system. On the second side of the card there is a second antenna system comprising a third radiation element that is made of a material and has a length selected to resonate at a second desired frequency, a second phase-shift element coupled to one end of the third radiation element, and a fourth radiation element coupled to the end of the second phase-shift element opposite the first radiation element, so that a radio signal passes through the first radiation element through the phase-shift element and through the second radiation element, the second radiation element is made of a material and has a length selected to resonate such that the first and second radiation elements cooperate to form a desired beam patter from the antenna system.

In another embodiment, a carrier, such as the circuit board illustrated in FIGS. 12 and 13, can be flexible, rigid, planar, or curve linear. The carrier can be formed into a shape, or held into shape by constraints, such as attachments to an enclosure. In another embodiment, an antenna system can span across the multiple sections of the carrier. The sections of the carrier can be aligned to each other at any desired angle.

The antennas described can be used in wireless communication devices. In one embodiment, a wireless communication device includes an enclosure. The device also includes a printed circuit board that has electronic components and a ground plane. There is at least one phased array antenna system that includes a first radiation element, a phase-shift element, and a second radiation element, wherein the first and second radiation elements are coupled to opposite ends of the phase-shift element and the first and second radiation elements cooperate to form a desired beam patter when a radio frequency signal at a desired frequency is feed to the first element, through the phase-shift element and to the second radiation element.

In an embodiment, the wireless communication device includes a plurality of phased array antenna systems that are orientated in the device such that a plurality of beam patterns are formed. Examples of wireless communication devices that can include the antenna systems include a wireless router, a mobile access point, or other type of wireless device.

In an embodiment a wireless communication device includes an enclosure, a radio, and at least two phased array antenna systems located within the enclosure, the antenna systems comprising a first radiation element, a phase-shift element, and a second radiation element, wherein the first and second radiation elements are coupled to opposite ends of the phase-shift element and the first and second radiation elements cooperate to form a desired beam pattern when a radio frequency signal at a desired frequency is feed to the at least one phased antenna system. The device also includes a switch coupling the radio to the at least two antenna systems, and a controller that controls the switch to selectively couple one of the at least two antenna systems to the radio. In one embodiment, a radio signal is feed through the first radiation element, through the phase-shift element and to the second radiation element. In another embodiment, the first radiation element is a lower radiating element comprising a dipole section and an H section that cooperate as a radiation element, and the second radiation element is a terminal radiating element, and a radio signal is feed to the end of the lower radiation element coupled to the phase-shift element In yet another embodiment, a wireless communication device includes an enclosure, at least two radios, and at least two phased array antenna systems located within the enclosure, the antenna systems comprising a first radiation element, a phase-shift element, and a second radiation element, wherein the first and second radiation elements are coupled to opposite ends of the phase-shift element and the first and second radiation elements cooperate to form a desired beam pattern when a radio frequency signal at a desired frequency is feed to the at least one phased antenna system. The device may just have one antenna connected to each radio and use the underlying processing circuitry to send suitable signals to each antenna from the various radios. For example some radios may be turned off while others may be active or the devices may utilize different phase shifts and amplitudes in the radio signals to use the directional antennas to maximize the performance. The device may also include a switch matrix coupling the at least two radios to the at least two antenna systems, and a controller that controls the switch matrix to selectively couple one of the radios to one of the antenna systems, and a different radio to a different antenna system. In one embodiment, a radio signal is feed through the first radiation element, through the phase-shift element and to the second radiation element. In another embodiment, the first radiation element is a lower radiating element comprising a dipole section and an H section that cooperate as a radiation element, and the second radiation element is a terminal radiating element, and a radio signal is feed to the end of the lower radiation element coupled to the phase-shift element. In another embodiment the embedded antennas may not be using the phase shift function, but rather be utilizing reflections from other components within the enclosure to form the necessary directional patterns.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1A:
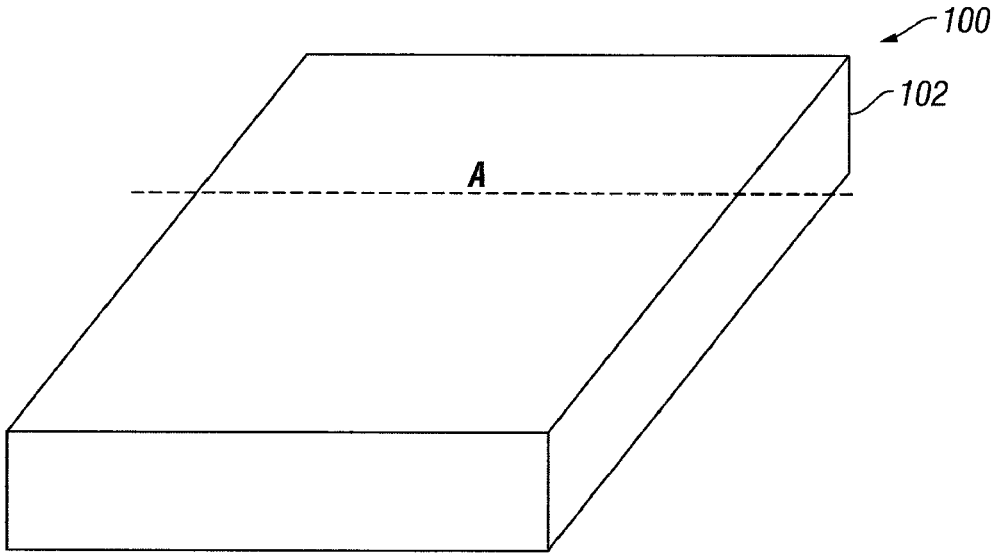
FIG. 1A includes a perspective view of a wireless communication device.

Certain embodiments as disclosed herein provide for methods, apparatuses, and systems for communication over a broadband wireless air interface. After reading this description it will become apparent how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

In one embodiment, an antenna can be included within an enclosure of a device which uses the antenna to transmit and receive radio frequency signals. The antenna can be configured to radiate in a desired direction, or pattern, and to thereby provide positive gain in the direction or pattern for the transmitted signal compared to an omni-directional antenna. In one aspect the antenna includes an array of antenna elements which cooperate to form a desired beam pattern. The arrangement of the antenna elements and the phase relationship of signals feed to the elements can be used to form the beam pattern. Also, the placement of the antenna elements within an enclosure of a device and the location of the antenna elements relative to other electronic components in the device can be used to form the desired beam pattern. For example, if the enclosure of the device is made of plastic, the enclosure can provide a "plastic load" on the antenna system that can be taken into account when determining the placement and phasing of the antenna elements. In addition, the location of other electronic components and printed circuit boards (PCB) in the device present a load to the antenna and can be taken into account when determining the placement and phasing of the antenna elements. In one embodiment, an antenna enclosed within an enclosure is configured to form a desired beam pattern as it operates and interacts with other components within the enclosure.

In one embodiment, the antenna includes antenna elements that can be arranged such that they cooperate to increase the gain of the antenna system in a desired beam pattern. Using more than one antenna element can increase the length of the overall antenna system which can decrease the negative effects of other components of the system in the enclosure by limiting those negative effects to a relatively smaller portion of the antenna system. In one aspect two or more of the antennas are used to provide different antenna patterns simultaneously or selectively.

In the following descriptions, many lengths and distances are expressed in terms of wavelengths of the radio frequencies used with the antennas. For example the antenna systems described can be configured for operation at any desired frequency (or a band centered around a frequency), such as, approximately 2.0 gigahertz (GHz), 5.0 Ghz, or other selected frequency. In is to be understood, the when wavelength (.lamda.) is used it typically takes into account the effects of the dielectric of the material (.lamda..sub.d) that the radio frequency is traveling through. Thus, in the following discussion unless specifically stated, wavelength takes into account the effects of the dielectric of the material (.lamda..sub.d) that the radio frequency is traveling through.

In one embodiment, an antenna includes antenna elements and phase-shift elements that are arranged in a phased relationship, such as in an array. The antenna elements and phase-shift elements cooperate to direct a radiated beam pattern of the antenna in a desired direction, or pattern. The antenna elements and phase-shift elements can also be arranged so that the antenna takes into account the location of the antenna relative to a circuit card, or printed circuit board (PCB) assemblies in an enclosure, the main components in the enclosure, and the enclosure itself, sometimes referred to as the plastic load of the enclosure.

Figure 1B:
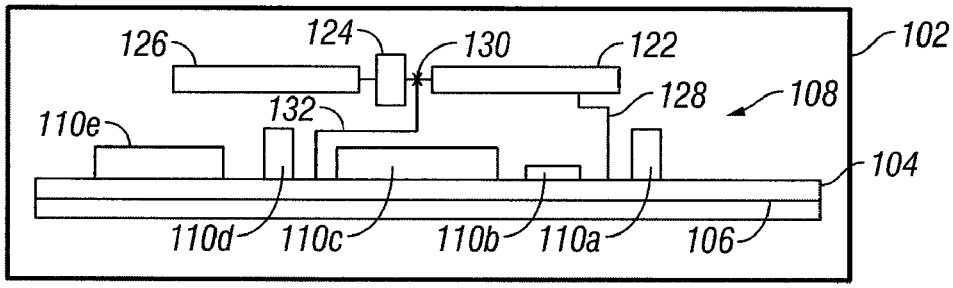
FIG. 1B is a cross section view of the wireless communication device illustrated in FIG. 1A.

FIG. 1 includes a perspective view of a wireless communication device 100. The communication device 100 includes an outer case or enclosure 102. FIG. 1B is a cross section view of the wireless communication device illustrated in FIG. 1A. As shown in FIG. 1B, enclosed within the case is a printed circuit board (or other suitable carrier) 104 which can be a multi-layer board. The printed circuit board can also include a ground plane 106. Circuit elements, semi-conductor chips, power supplies and other components included within the communication device are generally represented as components 110*a-e* located on the printed circuit board 104. In one embodiment, the communication device includes the components of a wireless network card including a radio located on the printed circuit board 104. Alternatively, the communication device can be a wireless router, a mobile access point or other type of wireless communication device.

In one embodiment an antenna system 108 in the device 100 is a passive phased array. The passive phased array includes a first radiation element, or antenna element 122, a phase-shift element, which can include, for example, a phase inverter or a delay element, 124, and a second radiation, or antenna, element 126. The radio of the communication device is coupled to the first antenna element for transmitting and receiving radio signals via a connection 128. In one embodiment the connection 128 is a coaxial cable and an appropriate connector. Alternatively, the connection 128 can be made by soldering a pin (not shown) connected to the end of the first antenna element 122 to the printed circuit board 104.

In an embodiment, the first and second antenna elements 122 and 126 can be electric conductors that have their electrical length selected to achieve a desired radiation at a selected frequency. For example, the electric conductors can be traces on a circuit board or other suitable carrier. In another example, the electric conductors can be lengths of wire attached, or affixed, to a circuit board, such as a printed wiring board or a substrate or a carrier, or a wall of the enclosure. The length of the conductors can be selected based on, for example, the operating frequency, the dielectric value of the conducting material, the form factor of the conductor, and the like.

In one embodiment, the phase-shift element 124 shifts the phase, or delays, the signal by 180 degrees. The phase-shift element allows the two antenna elements 122 and 126 to have an additive gain effect on the overall antenna system 108 producing a desired antenna radiation, or beam, pattern. In other embodiments, the phase-shift element 124 may shift the phase of the signal feed to the second antenna element 126 by any desired amount to obtain a desired coupling between the two antenna elements.

In one embodiment a switch 130, such as a pin diode, is located between the first antenna element 122 and the phase-shift element 124. A control line can be 132 can be used to control the switch 130. When the switch is closed, the antenna system 108 operates in the manner described above. When the switch is open, only the first antenna element 122 is operational. In this way, the switch allows the antenna 100 to have two different patterns.

Additionally, the first antenna element 122 and/or the second antenna element 126 can include switched components (not shown) which can change the resonant frequency of the antenna elements when the components are switched on or off. The switched components provide the ability to make the antenna elements configurable such that their resonant frequency can be changed. Changing the resonant frequency of the antenna elements can be thought of as electrically lengthening or shortening the elements. Thus, each of the antenna elements can be configured to resonate at different frequencies depending on the state of the associated switched components. In one embodiment, only one switched component is used on only one of the antenna elements. The switched components can be controlled with control lines or with a bias voltage applied on the signal path.

In an embodiment, the first antenna element 122, the second antenna element 126, and the phase-shift element 124 can all be configurable. For example, the antenna elements can be configurable as described above. The phase-shift element can be configured by including switched components that, for example, electrical short out portions of the phase-shift element, effectively decreasing the total length, or delay, of the phase-shift element 124. In this way the antenna and phase-shift elements can be configured to cooperate in different fashions to create different radiation patterns. In another embodiment, the phase shift element can have its overall length increased to change the phase shift introduced by the phase-shift element. In addition, the antenna and phase-shift elements can be configured to operate, or resonant, at different frequencies.

In one embodiment, the antenna elements can be located above the components of the communication device 110*a-e* and oriented generally in a plane parallel to the plane of the printed circuit board. This orientation can decrease the detuning effects of those components relative to, for example, placing the same antenna system on the surface of the printed circuit board.

In an embodiment, the ground plane 106 of the printed circuit board 104 can act as a reflector for the antenna system to create a more directional antenna pattern. The amount of reflection is influenced by the distance between the antenna system and the ground plane. For example, a distance in the range of approximately one-quarter wavelength (.lamda..sub.d/4) of the transmitted signal in the transmission path may provide satisfactory reflectance.

The enclosure 100 can act as a load to the antenna system 108. For example, the location of the antenna elements relative to the walls, top, and bottom of the enclosure can vary the beam pattern generated by the antenna system 108. Aspects of the enclosure, such as wall thickness of the enclosure, materials used in the construction of the enclosure, and the like, can be taken into account in the design and placement of the antenna elements to produce a desired radiation pattern.

Figure 2:
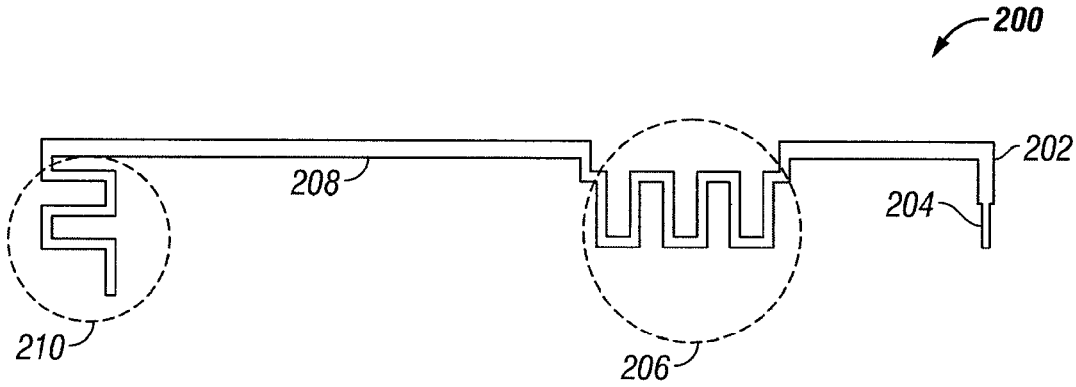
FIG. 2 is a plan view of an embodiment of an antenna that can be used in a device such as the communication device depicted in FIG. 1A.

FIG. 2 is a plan view of an embodiment of an antenna 200 than can be used in a device such as the communication device depicted in FIG. 1A. The antenna 200 includes a first antenna element 202 which extends from a tab 204 to a phase-shift element 206. In one embodiment, the tab 204 can be soldered to a printed circuit board or other carrier, for example, to a via or to a strip line which provides the antenna a connection to a radio. In one embodiment the dimension of the first antenna element 202 is approximately one-half wavelength (.lamda..sub.d/2) of the transmitted signals in the transmission path. In this embodiment, the phase-shift element 206 is configured as a delay line one-half wavelength (.lamda..sub.d/2) of the transmitted signals in the transmission path.

In the example of FIG. 2, a second antenna element 208 is coupled to the output of the phase-shift element 206. The opposite end of the second antenna element 208 is coupled to a second phase-shift element, or delay line, 210 which is a reflective distance of approximately one-quarter wavelength (.lamda..sub.d/4) of the transmitted signal in the transmission path. The reflective distance can be selected taking into account the frequency range(s) in which the antenna will be used, the dielectric constant of the transmission path and the desired efficiency of the antenna. In one embodiment, the end of the phase-shift 210 opposite the second antenna element 208 is soldered to a ground connection for the antenna 200. In this embodiment the antenna has two connection points to the printed circuit board to provide mechanical support and signal connections.

Figure 3:
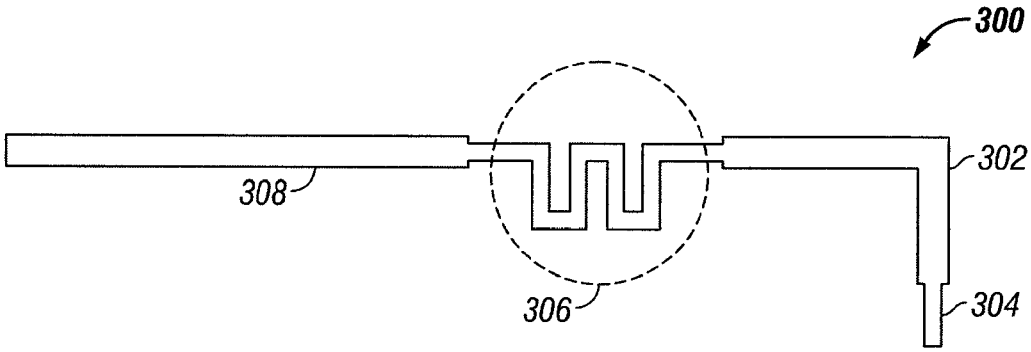
FIG. 3 is a plan view of an embodiment of an antenna than can be used a device such as the communication device depicted in FIG. 1A.

FIG. 3 is a plan view of another embodiment of an antenna 300 than can be used in a device such as the communication device depicted in FIG. 1A. The antenna 300, similarly to the antenna 200 of FIG. 2, includes a first antenna element 302 which extends from a first tab 304. The opposite end of the first antenna element 302 is coupled to a phase-shift element 306. The opposite end of the phase-shift element is coupled to a second antenna element 308. In this embodiment, the opposite end of the second antenna element 308 is electrically open, and unattached.

Figure 4:
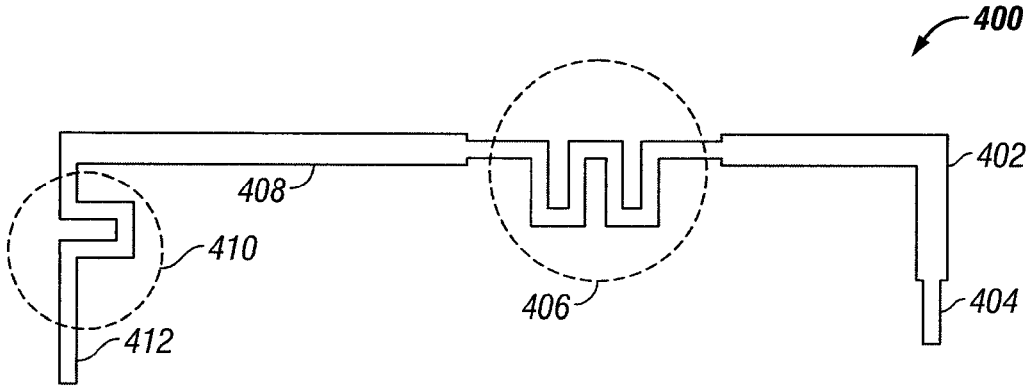
FIG. 4 is a plan view of an embodiment of an antenna than can be used in a device such as the communication device depicted in FIG. 1A.

FIG. 4 is a plan view of still another embodiment of an antenna 400 than can be used in a device such as the communication device depicted in FIG. 1A. The antenna 400 is similarly to the antenna 200 of FIG. 2, and includes a first antenna element 402 which extends from a first tab 404. The opposite end of the first antenna element 402 is coupled to a phase-shift element 406. The opposite end of the phase-shift element is coupled to a second antenna element 408 that has its opposite end attached to a second phase-shift element 410. The second phase-shift line 410 is coupled to a second tab 412. The antenna 400 of FIG. 4 is configured to operate at a different frequency that the antenna 200 of FIG. 2. For example, the first and second antenna elements 402 and 404 can be constructed with different materials, or have a different form factor. In the example of FIG. 4, the phase-shift elements 408 and 410 can provide a desired phase shift at the different frequency by being constructed with different materials or having a different form factor. For example, the total length of the first and second phase-shift elements 406 and 410 of FIG.

4 may be shorter than the overall length of the phase-shift elements 206 and 210 of FIG. 2.

Figure 5:
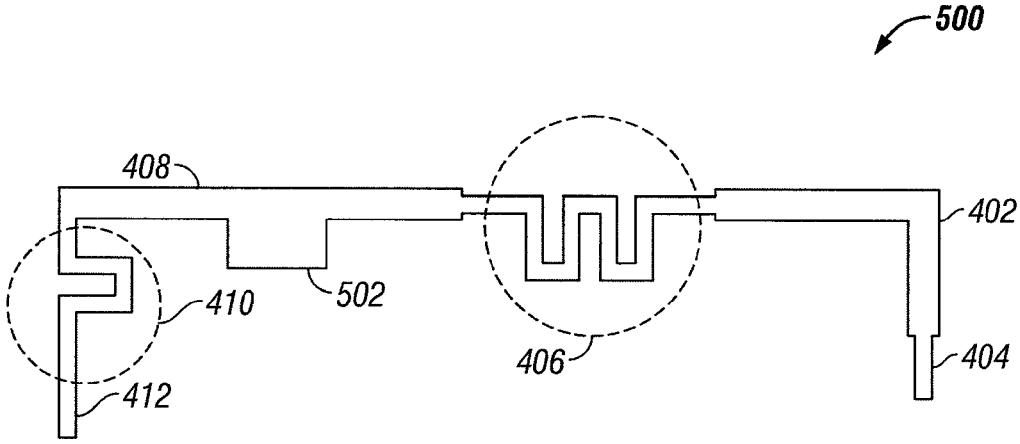
FIG. 5 is a plan view of an embodiment of an antenna than can be used in a device such as the communication device depicted in FIG. 1A.

FIG. 5 is a plan view of another embodiment of an antenna 500 than can be used in a device such as the communication device depicted in FIG. 1A. The antenna 500 is similarly to the antenna 400 of FIG. 4, and includes the first antenna element 402, the first tab 404, the phase-shift element 406, the second antenna element 408, the second phase-shift element 410 and second tab 412. The antenna 500 also includes a load 502 coupled to the second antenna element 408. The load 502 can be selected to change the resonant frequency and antenna match of the second antenna element.

While FIG. 5 illustrates an example of a load 502 coupled to the second antenna element 408, in other embodiments a load can be coupled to other elements in the antenna 500. In addition, loads can be couple to more than one element in the antenna 500. Also, the load can be configured such that it can be switched in-and-out of being coupled to an antenna element.

Figure 6:
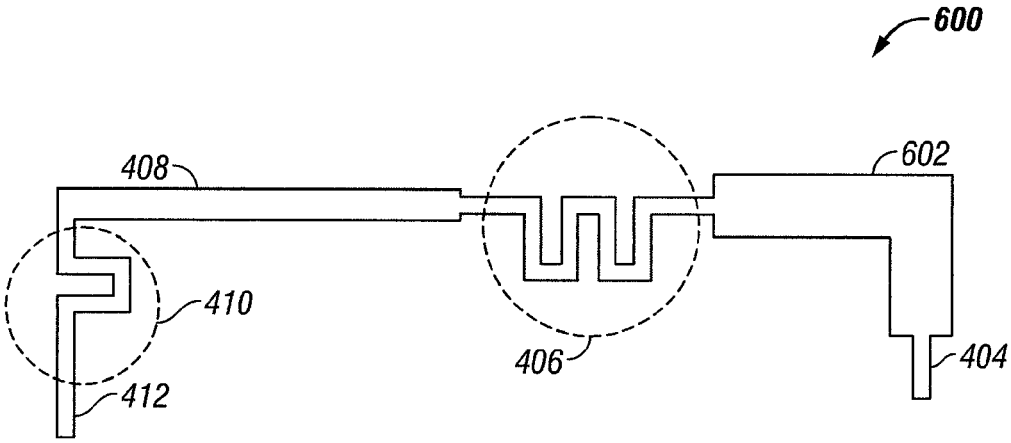
FIG. 6 is a plan view of another embodiment of an antenna than can be used in a device such as the communication device depicted in FIG. 1A.

FIG. 6 is a plan view of another embodiment of an antenna 600 than can be used in a device such as the communication device depicted in FIG. 1A. The antenna 600 illustrated in FIG. 6 is similarly to the antenna 400 of FIG. 4, and includes a first antenna element 602, the first tab 404, the phase-shift element 406, the second antenna element 408, the second phase-shift element 410 and second tab 412. In the example of FIG. 600, the first antenna element 602 has a different form factor than the first antenna element 402 of FIG. 4. The different form factor of the first antenna element 602 of FIG. 6 can change the resonant frequency of the first antenna element 602 from the resonant frequency of the first antenna element 402 in FIG. 4.

Figure 7:
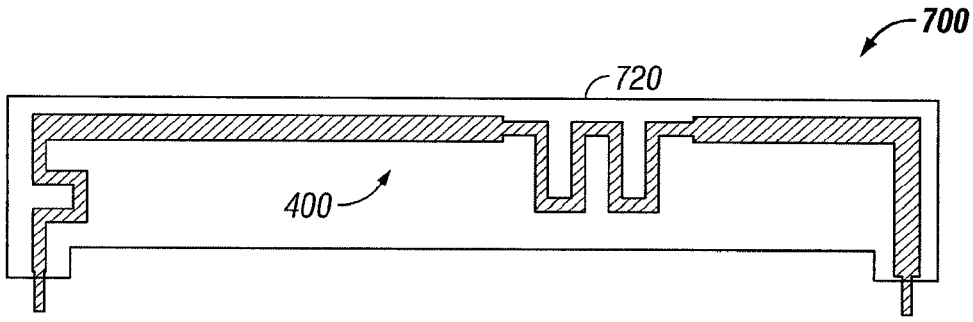
FIG. 7 is a plan view of an embodiment of an antenna system than can be used in a device such as the communication device depicted in FIG. 1A.

FIG. 7 is a plan view of an embodiment of an antenna 700 than can be used in a device such as the communication device depicted in FIG. 1A. In the example illustrated in FIG. 7, the antenna system 700 includes an antenna 400 as illustrated in FIG. 4 that encased in a polymer or plastic over molding 720. Typically, the casing changes the dielectric constant of the antenna. For example, a polymer or plastic casing typically decreases .lamda..sub.d which correspondingly allows for smaller (shorter) antenna elements. The conductive elements of the antenna can be inexpensively manufactured as a stamped copper piece or patterned conductive foil on a substrate. Alternatively, the casing can include a mold and conductive material injected into the mold. The casing on the antenna can include a flat surface suitable for use by a vacuum pick and place machine which can greatly simplify the assembly of the overall device. It is noted that this embodiment does not require an RF connector or a coaxial cable. The antenna can be a separate, pre-tuned assembly which is easily combined with the circuit board assembly. In other embodiments, different configurations of antennas can be encased.

Figure 8:
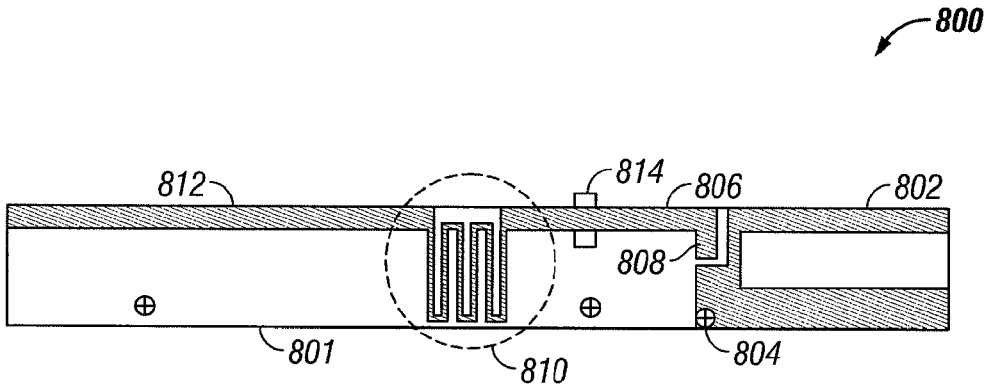
FIG. 8 is a plan view of a further embodiment of an antenna than can be used in a device such as the communication device depicted in FIG. 1A.

FIG. 8 is a plan view of a further embodiment of an antenna 800 that can be used in a device such as the communication device depicted in FIG. 1A. The antenna depicted in FIG. 8 can be formed as copper traces on a small piece of printed circuit board or other suitable carrier or backing 801. In the embodiment illustrated in FIG. 8, the antenna system 800 includes an H section 802 which includes a ground connection 804. An upper dipole section 806 includes a transmission path connection 808 which couples the upper dipole section 806 to a radio. The upper dipole section 806 and the H section 802 are collectively referred to as the lower radiating element and cooperate to act as a radiation element. In one embodiment, upper dipole section 806 and the H section 802 cooperate to act like a dipole antenna. The upper dipole section 806 is coupled to a phase-shift element 810. In one embodiment, the phase-shift element 810 is a delay line of approximately one-half wavelength (.lamda..sub.d/2) of the transmitted signal in the transmission path. The opposite end of the phase-shift element 810 is coupled to a terminal radiating element 812. The terminal radiating element 812 and the lower radiating element have an additive gain effect on the overall antenna system 800 to form a desired antenna pattern. The H section 802 also offers additional dimension for antenna match and tuning.

In one embodiment a switch 814, such as a pin diode, is located between the lower radiating element and the phase-shift element 810. In another embodiment, the switch 814 is located at a desired location along the phase-shift element 810. A control line, not shown, can be used to control the switch 814. When the switch 814 is closed, the antenna system 800 operates in the manner described above. When the switch 814 is open, only the lower radiating element is functional. In this way the switch 814 can allow the antenna system 800 to have two different radiation, or beam, patterns.

Additionally, the lower radiating element and/or the terminal radiating element 812 can include switched components, not shown, which can change the resonant frequency of the antenna elements when the components are switched on or off. The switched components provide the ability to make the antenna elements configurable such that their resonant frequency can be changed. Changing the resonant frequency of the antenna elements can be thought of as electrically lengthening or shortening the elements. Thus, each of the antenna elements can be configured to resonate at different frequencies depending on the state of the associated switched components. In one embodiment, only one switched component is used on only one of the antenna elements. The switched components can be controlled with control lines or with a bias voltage applied on the signal path.

Figure 9:
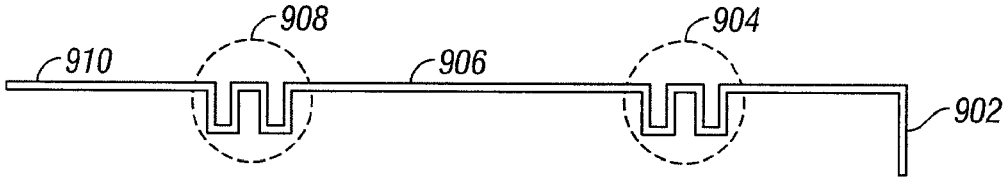
FIG. 9 is a plan view of another embodiment of an antenna than can be used in a device such as the communication device depicted in FIG. 1A.

FIG. 9 is a plan view of another embodiment of an antenna 900 that can be used in a device such as the communication device depicted in FIG. 1A. The antenna system depicted in FIG. 9 illustrates an example of an antenna system with multiple antenna elements. As shown in FIG. 9, the antenna system 900 includes a first antenna element 902, a first phase-shift element 904, a second antenna element 906, a second phase-shift element 908, and a third antenna element 910. While the example of FIG. 9 illustrates three antenna elements and two phase-shift element, any desired number of antenna elements and phase-shift elements can be used in an antenna system. In one embodiment the dimension of the first antenna element 902 is approximately one-quarter wavelength (.lamda..sub.d/4), and the phase-shift elements and other antenna elements are approximately one-half wavelength (.lamda..sub.d/2) of the transmitted signals in the transmission path. In other embodiments, the elements can be other fractions of wavelengths.

Figure 10A:
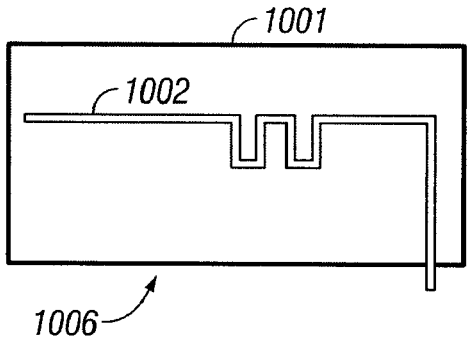
FIG. 10A is a plan view of a first side of a carrier that includes a first antenna system.
Figure 10B:
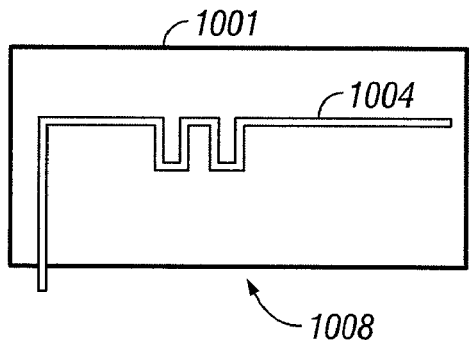
FIG. 10B is a plan view of a second side of the carrier illustrated in FIG. 10A, that includes a second antenna system.

FIG. 10A is a plan view of a first side of a carrier 1001, such as a circuit board or substrate. As shown in FIG. 10A, the first side 1006 of the carrier, or circuit board, 1001 includes a first antenna 1002 that can be configured to operate at a first frequency. FIG. 10B is a plan view of a second side of the carrier 1001 illustrated in FIG. 10A. As shown in FIG. 10B, the second side 1008 of the carrier 1001 includes a second antenna 1004 that can be configured to operate at a second frequency. Thus, the antenna system illustrated in FIGS. 10A and B can operate at two different frequencies as a dual band antenna. In other embodiments, additional antenna systems can be included on the carrier 1001 to have multi-band antennas. In another embodiment, the first and second antennas can be configured to operate at the same frequency. The antennas 1002 and 1004 can be implemented in accordance with any of the examples illustrated in FIGS. 2-9.

Figure 11A:
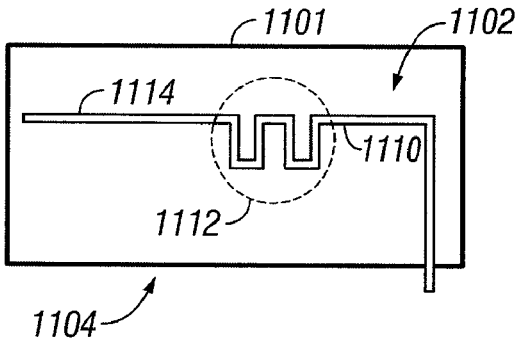
FIG. 11A is a plan view of a first side of a carrier that includes a portion of an antenna system.
Figure 11B:
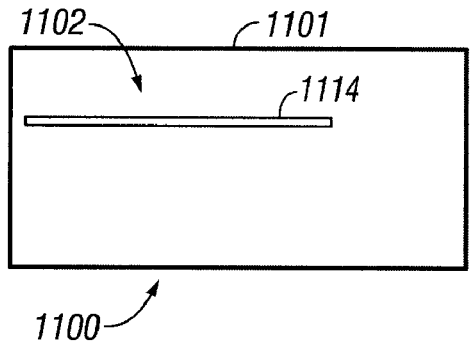
FIG. 11B is a plan view of a second side of the carrier illustrated in FIG. 11A, that includes another portion of the antenna system.

FIG. 11A is a plan view of a first side of a carrier that includes a portion of an antenna system. As shown in FIG. 11A, a first side 1104 of the carrier or circuit board 1101 can include a portion of the antenna 1102, such as a first antenna element 1110, a phase-shift element 1112, and a portion of a second antenna element 1114. FIG. 11B is a plan view of a second side of the carrier illustrated in FIG. 11A, that includes another portion of the antenna system. As shown in FIG. 11B, the second antenna element 1114 extends to the second side of the carrier or circuit board 1101 through a via or is fabricated on the same PCB. In another embodiment, the antenna continues around the end of the carrier or circuit board 1101 onto the second side of the carrier or circuit board. The point where the antenna element extends to the second side of the carrier can be located anywhere along the length of the first antenna element or the second antenna element, or the phase-shift element. In one embodiment, the two, or more elements can be in different band or multi-band, which resonate at desired frequencies. The antenna 1102 can be implemented in accordance with any of the examples illustrated in FIGS. 2-9.

Figure 12:
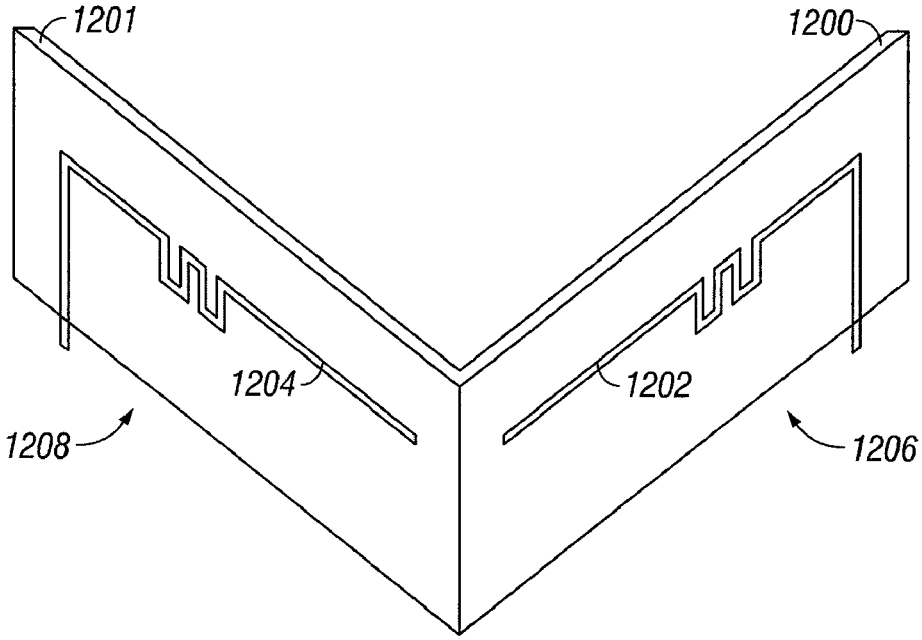
FIG. 12 is a perspective view of another embodiment of an antenna system.

FIG. 12 is a perspective view of another embodiment of an antenna system. As shown in FIG. 12 a carrier, or circuit board includes two sections 1200 and 1201. The two sections can be at angles to each other. For example, they can be at right angles to each other or at 60 degree angles, or 45 degree angles, or any desired angle to each other. In one embodiment, the carrier sections 1200 and 1201 each include an antenna system 1202 and 1204. In other embodiments, there can be any desired number of antenna systems on the carrier sections 1200 and 1201, and the number of antenna systems on each section can be different. In one embodiment, the two carrier sections 1200 and 1201 are two separate sections that are attached. In another embodiment, the two carrier sections are a single unit. The antennas 1202 and 1204 can be implemented in accordance with any of the examples illustrated in FIGS. 2-9.

Figure 13:
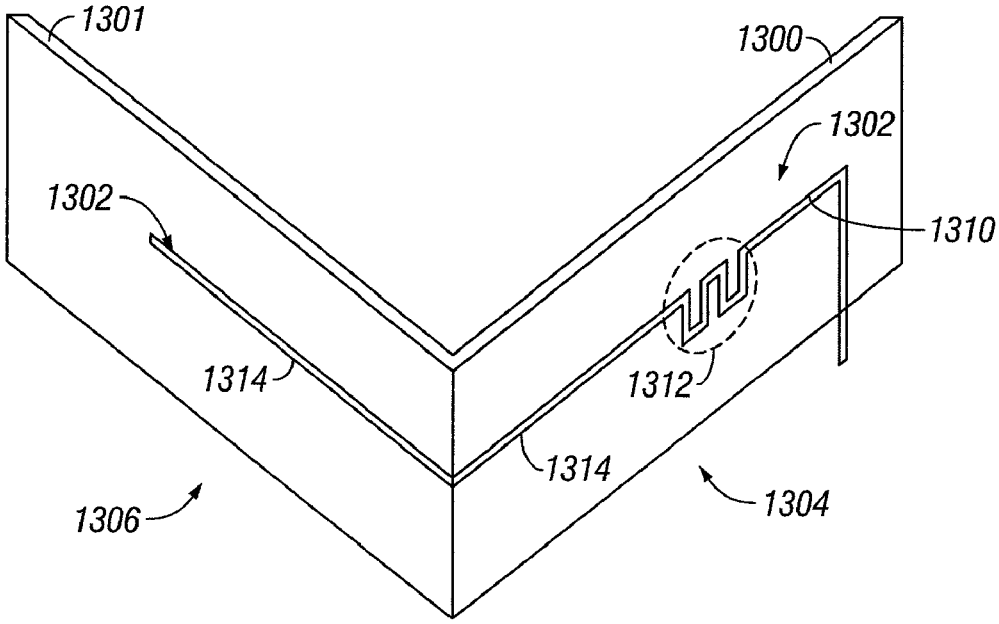
FIG. 13 is a perspective view of another embodiment of an antenna system.

FIG. 13 is a perspective view of another embodiment of an antenna system. Similar to the embodiment of FIG. 12, in FIG. 13 a carrier, or circuit board includes two sections 1300 and 1301. The two sections can be at angles to each other. For example, they can be at right angles to each other or at 60 degree angles, or 45 degree angles, or any desired angle to each other. In one embodiment, the carrier sections 1300 and 1301 each include at least a portion of an antenna system 1302. For example, in the example of FIG. 13 the first section 1300 includes a first radiation element 1310, a phase-shift element 1312 and a portion of a second radiation element 1314. The second radiation element 1314 extends onto the second section 1301 of the carrier. In other embodiments, the portion of the antenna 1302 that extends onto the second section 1301 of the carrier can be any portion of the antenna 1302. Also, in other embodiments, there can be any desired number of antenna systems on the carrier sections 1300 and 1301, and the number of antenna systems on each section can be different. In one embodiment, the two carrier sections 1300 and 1301 are two separate sections that are attached. In another embodiment, the two carrier sections are a single unit. The antenna 1302 can be implemented in accordance with any of the examples illustrated in FIGS. 2-9.

In another embodiment, the carrier, such as the carrier illustrated in FIGS. 12 and 13, can be flexible, rigid, planar, or curve linear. The carrier can be formed into a shape, or held into shape by constraints, such as attachments to an enclosure. In another embodiment, an antenna can span across multiple sections of the carrier. The sections of the carrier can be aligned to each other at any desired angle.

Figure 14:
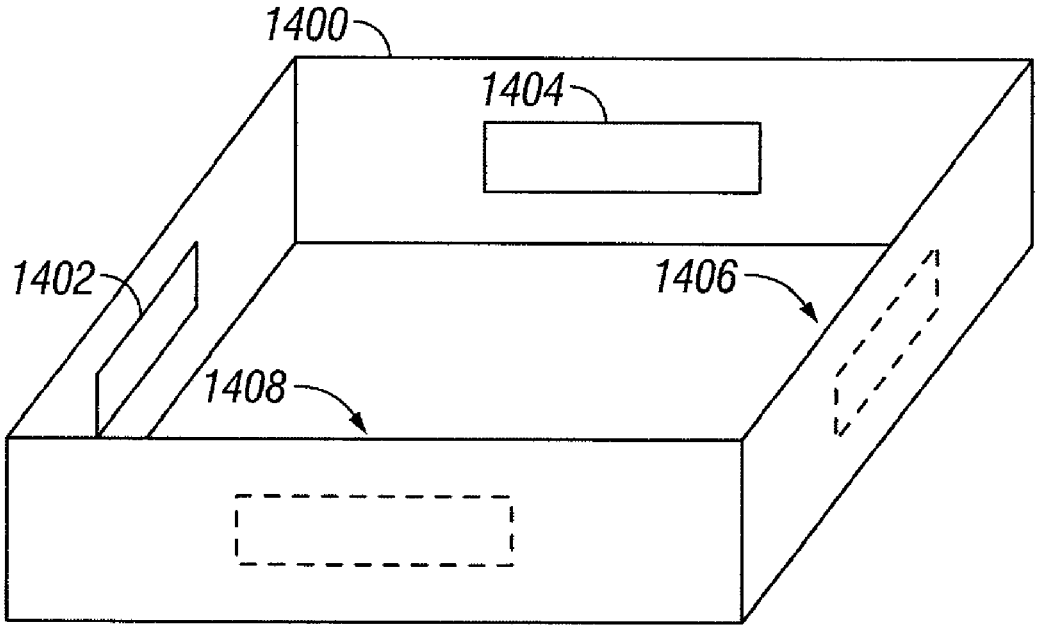
FIG. 14 is a perspective view of a wireless communication device enclosure that includes multiple antenna systems.

In another embodiment, two or more antenna systems can be used in a diversity system. FIG. 14 is a perspective view of a wireless communication device enclosure 1400 that includes multiple antenna systems. As shown in the example of FIG. 14, the device 1400 is generally rectangular. In other embodiments, the enclosure can be other shapes, such as, oval, circular, or other irregular shapes.

In the example illustrated in FIG. 14, the enclosure includes 1400 includes four antenna systems 1402, 1404, 1406, and 1408. Each of the antenna systems 1402, 1404, 1406, and 1408 are aligned along one of the side walls of the enclosure 1400. The antenna systems, can be implemented in accordance with any of the examples illustrated in FIGS. 2-13. In one embodiment, each antenna system is configured to produce a beam pattern that extends generally outward and perpendicular to the antenna system.

While the example of FIG. 14 includes four antenna systems 1402, 1404, 1406, and 1408, in other embodiments different numbers of antenna systems can be used. For example, an enclosure may use one, two, three, four, or more antenna systems. Likewise, different orientations of the antenna systems can be used to produce desired beam patterns.

The antenna systems described herein can be used for various wireless communication protocols and at various frequency ranges. For example, the system can be used at frequency ranges and having bands centered around 2.0 Ghz and 5.0 Ghz.

Figure 15:
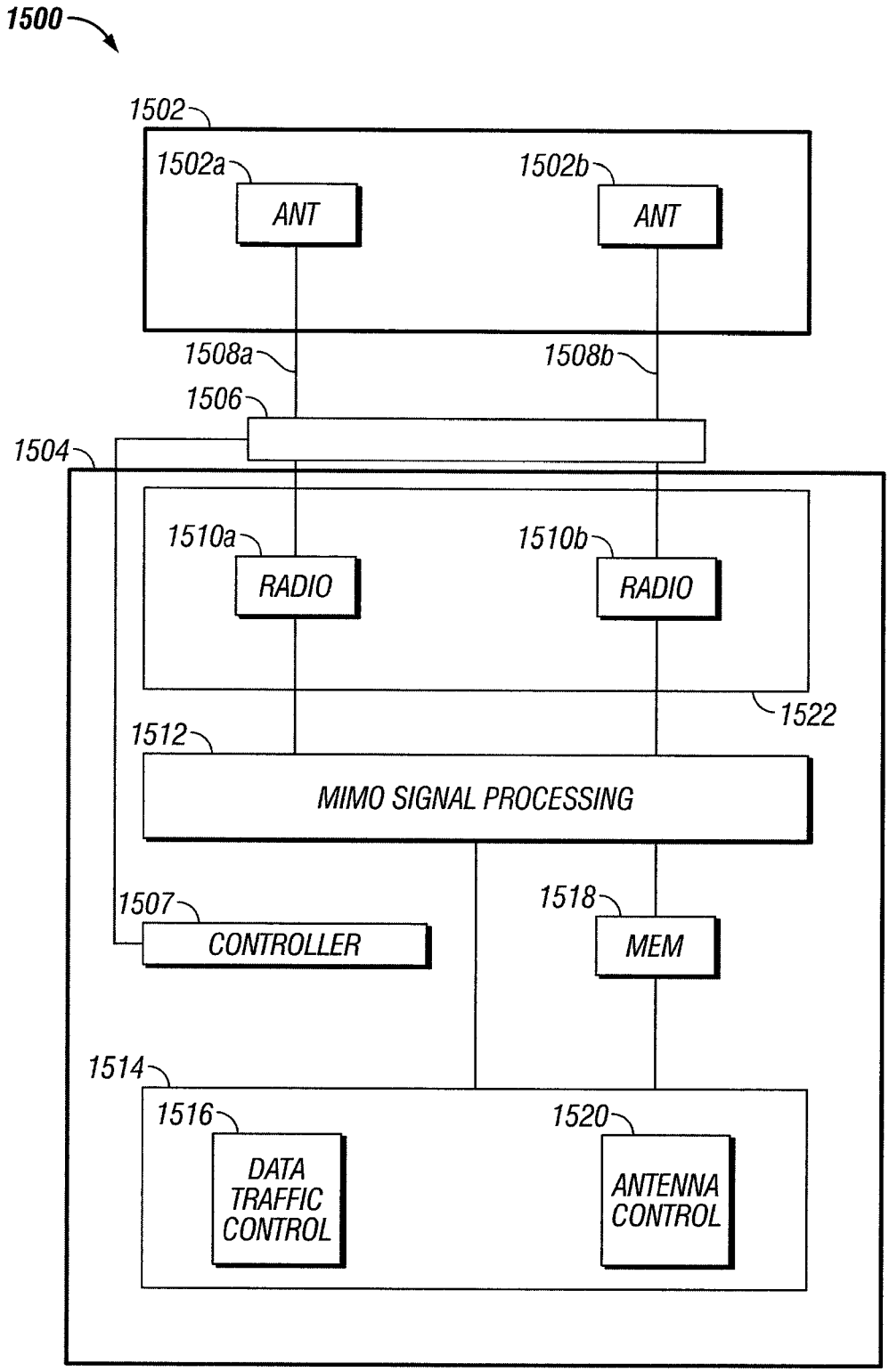
FIG. 15 is a functional block diagram of an embodiment of a wireless communication device.

Embodiments described herein includes the combination of described antenna system combined and used with various radio systems. FIG. 15 is a functional block diagram of an embodiment of a wireless communication device 1500 that may use multiple antennas, such as the antenna illustrated in FIGS. 2-13. The wireless device 1500 can be, for example, a wireless router, a mobile access point, a wireless network adapted, or other type of wireless communication device. In addition, the wireless device can employ MIMO (multiple-in multiple-out) technology. The communication device 1500 includes two antenna systems 1502*a* and 1502*b* which are in communication with a radio system 1504. In other embodiments, different numbers of antennas 1502 may be used. In the example illustrated in FIG. 15, each antenna is configured to radiate in a predetermined pattern. In other embodiments, the antennas can be controllably configured to radiate in different patterns.

The radio system 1504 includes a radio sub-system 1522. In the example of FIG. 15, the radio sub-system 1522 includes two radios 1510*a* and 1510*b*. In other configurations different numbers of radios 1510 may be included. The radios 1510*a* and 1510*b* are in communication with a MIMO signal processing module, or signal processing module, 1512. The radios 1510*a* and 1510*b* generate radio signals which are transmitted by the antennas 1502*a* and 1502*b* and receive radio signals from the antennas 1502*a* and 1502*b*. In one embodiment, a switch matrix, or a plurality of switches, 1506 selectively couples the radios 1510*a* and 1510*b* to transmit and receive lines 1508*a* and 1508*b* to couple the radio to the selected antenna system 1502*a* and 1502*b*. A controller 1507 can control the operation of the switch matrix 1506 to selectively couple the radios 1508*a* and 1508*b* to the desired antenna system 1502*a* and 1502*b*. In another embodiment each antenna 1502*a* and 1502*b* is coupled to a single corresponding radio 1510*a* and 1510*b*. Although each radio is depicted as being in communication with a corresponding antenna by a transmit and receive line 1508*a* and 1508*b*, more such lines can be used.

The signal processing module 1512 implements the MIMO processing. MIMO processing is well known in the art and includes the processing to send information out over two or more radio channels using the antennas 1502*a* and 1502*b* and to receive information via multiple radio channels and antennas as well. The signal processing module can combine the information received via the multiple antennas into a single data stream. The signal processing module may implement some or all of the media access control (MAC) functions for the radio system and control the operation of the radios so as to act as a MIMO system. In general, MAC functions operate to allocate available bandwidth on one or more physical channels on transmissions to and from the communication device. The MAC functions can allocate the available bandwidth between the various services depending upon the priorities and rules imposed by their QoS. In addition, the MAC functions operate to transport data between higher layers, such as TCP/IP, and a physical layer, such as a physical channel. The association of the functions described herein to specific functional blocks in the figure is only for ease of description. The various functions can be moved amongst the blocks, shared across blocks and grouped in various ways.

A central processing unit (CPU) 1514 is in communication with the signal processor module 1512. The CPU 1514 may share some of the MAC functions with the signal processing module 1512. In addition, the CPU can include a data traffic control module 1516. Data traffic control can include, for example, routing associated with data traffic, such as a DSL connection, and/or TCP/IP routing. A common or shared memory 1518 which can be accessed by both the signal processing module 1512 and the CPU 1514 can be used. This allows for efficient transportation of data packets between the CPU and the signal processing module.

In an embodiment, the CPU 1514 can control the switch modules, not shown, in the antennas 1502*a* and 1502*b*. For example, the CPU 1514 can provide a control signal to configure the switches in the antennas 1502*a* and 1502*b*. Alternatively, the CPU 1514 can provide a signal indicating the desired configuration of the switch modules to a controller, not shown, in the antenna 1502*a* and 1502*b*, and the controller in the antenna can control the switch modules. In another embodiment, a control signal for controlling the switch modules can be combined with the radio signal.

In one embodiment, a signal quality metric for each received signal and/or transmitted signal on a communication link can be monitored to determine which beam pattern direction of an antenna is preferred, for example, which direction it is desired to radiate or receive RF signals. The signal quality metric can be provided from the MIMO signal processing module 1512. The MIMO signal processing module has the ability to take into account MIMO processing before providing a signal quality metric for a communication link between the wireless communication device 1500 and a station with which the wireless communication device is communicating. For example, for each communication link the signal processing module can select from the MIMO techniques of receive diversity, maximum ratio combining, and spatial multiplexing each. It can also use the technique of selecting which radios to activate this way effectively using diversity in either just the transmit or receive function or both, while taking advantage of the fact that the antenna patterns of the different antennas connected to the different radios are directional. The signal quality metric received from the signal processing module, for example, data throughput or error rate, can vary based upon the MIMO technique being used. A signal quality metric, such as received signal strength, can also be supplied from one or more of the radios 1510*a* and 1510*b*. The signal quality metric can be used to determine or select which antenna, and the direction of the beam pattern of the antenna it is desired to use. For example, the signal metric can be used to determine the desired configuration of the switch modules in the antennas 1502*a* and 1502*b*.

In another embodiment, the wireless communication device 1500 does not include a switch matrix 1506. In this embodiment, each radio 1510*a* and 1510*b* is coupled to an antenna 1502*a* and 1502*b* respectively by transmit and receive lines 1508*a* and 1508*b*. In this configuration the signal processing module 1512, or the CPU 1512, or other module, can select one radio or the other radio during operation of the device 1500.

Figure 16:
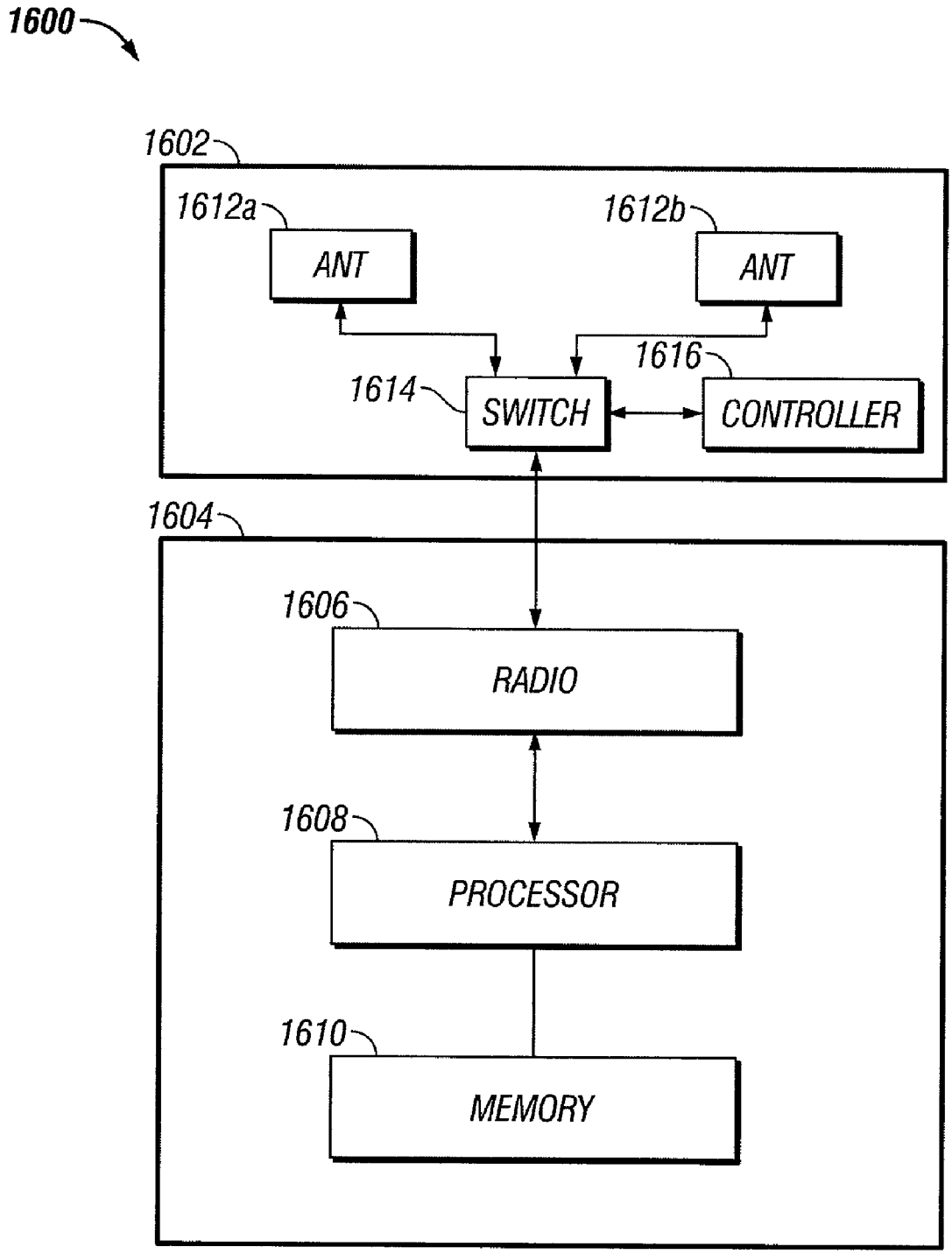
FIG. 16 is a functional block diagram of another embodiment of a wireless communication device.

FIG. 16 is a functional block diagram of another embodiment of a wireless communication device 1600 that may use an antenna system 1612 which can be one or more antennas as depicted in FIGS. 2-13. The wireless device 1600 can be, for example, a wireless router, a mobile access point, a wireless network adapted, or other type of wireless communication device. In the embodiment of FIG. 16, the communication device 1600 includes an antenna system 1602 which is in communication with a radio system 1604. In the example of FIG. 14, the radio system 1604 includes a radio module 1606, a processor module 1608, and a memory module 1610. The radio module 1606 is in communication with the processor module 1608. The radio module 1606 generates radio signals which are transmitted by the antenna system 1602 and receive radio signals from the antenna system.

The processor module 1608 may implement some or all of the media access control (MAC) functions for the radio system 1604 and control the operation of the radio module 1606. In general, MAC functions operate to allocate available bandwidth on one or more physical channels on transmissions to and from the communication device 1400. The MAC functions can allocate the available bandwidth between the various services depending upon the priorities and rules imposed by their QoS. In addition, the MAC functions can operate to transport data between higher layers, such as TCP/IP, and a physical layer, such as a physical channel. The association of the functions described herein to specific functional blocks in the figure is only for ease of description. The various functions can be moved amongst the blocks, shared across blocks and grouped in various ways. The processor is also in communication with a memory module 1610 which can store code that is executed by the processing module 1608 during operation of the device 1600 as well as temporary store during operation.

In the example of FIG. 16, the antenna 1602 includes a sensor/switch module 1614 and a control module 1616. In one embodiment, the sensor/switch module is in communication with antennas 1612*a* and 1612*b* and the radio module 1604 to communicate signals to and from the radio to the antennas 1612*a* and 1612*b*. The sensor/switch module 1614 can operate to control switch modules in the antenna system 1602 to select, and/or configure the antennas 1612*a* and 1612*b* to form a beam pattern in a desired configuration. The sensor/switch module 1614 can also provide an indication of signal quality to the controller 1616 and the controller 1616 can control the sensor/switch module 1614 to select and/or configure the antennas 1612*a* and 1612*b* in a desired configuration based upon the indication of signal quality. For example, the switch/sensor can measure the coefficient of reflectance of a transmitted signal. The antenna can be configured in each of its configurations with signal quality indications associated with each configuration compared to select the desired configuration.

While the description of FIG. 16 describes the sensor/switch 1614 being located in the antenna system 1602, the sensor/switch can be in other locations, for example in the radio system. In addition, the functions performed by the sensor/switch 1614 can be performed in other modules of the overall system.

Figure 17:
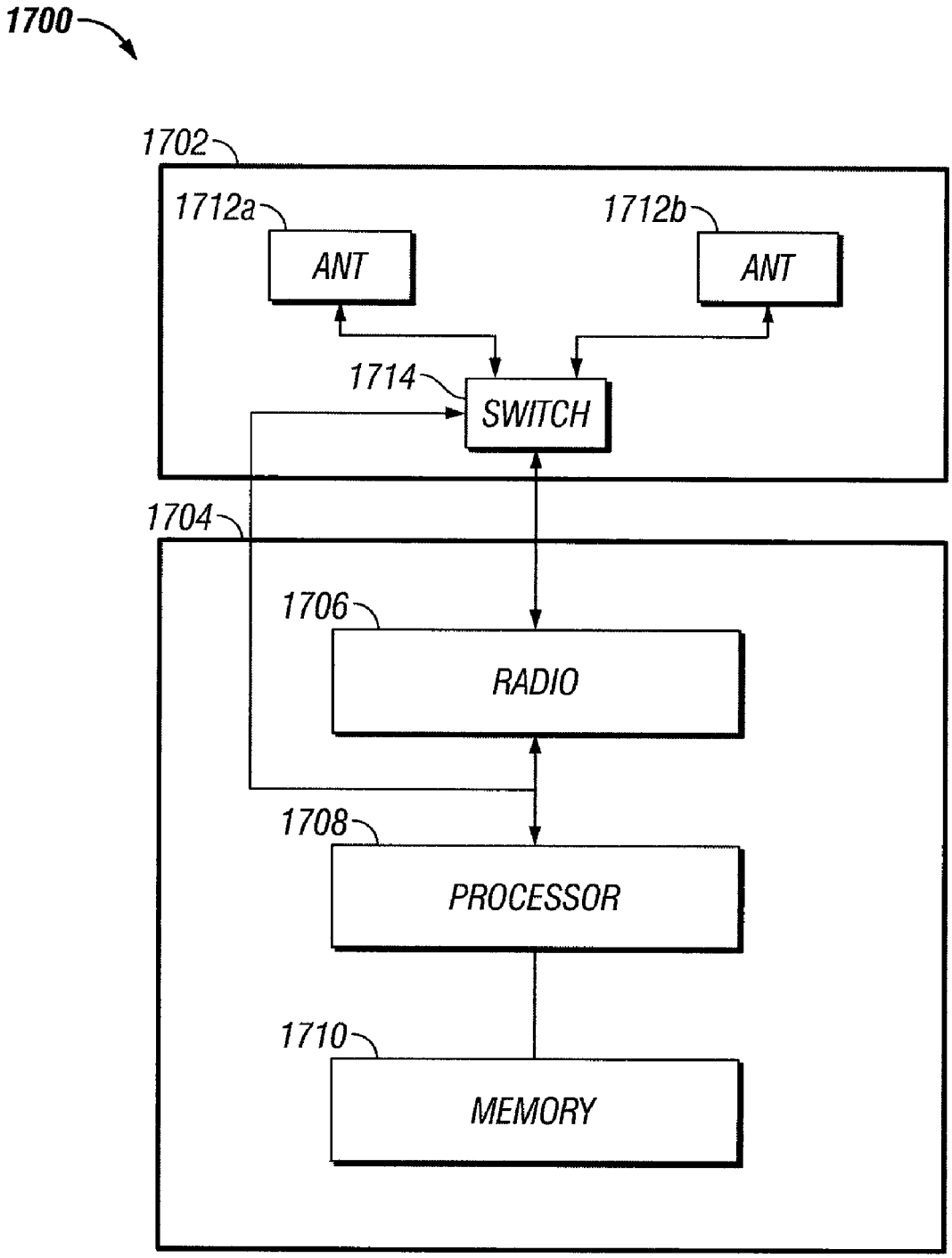
FIG. 17 is a functional block diagram of yet another embodiment of a wireless communication device.

FIG. 17 is a functional block diagram of yet another embodiment of a wireless communication device 1700 that includes an antenna system which can be one or more antennas as depicted in FIGS. 2-13 described above. The wireless device 1700 can be, for example, a wireless router, a mobile access point, a wireless network adapted, or other type of wireless communication device. In the embodiment of FIG. 17, the communication device 1700 includes an antenna system 1702 which is in communication with a radio system 1704. In the example of FIG. 17, the radio system 1704 includes a radio module 1706, a processor module 1708, and a memory module 1710. The radio module 1706 is in communication with the processor module 1708. The radio module 1706 generates radio signals which are transmitted by the antenna system 1702 and receive radio signals from the antenna system.

In the example of FIG. 17, the antenna 1702 can be configured to radiate in a desired direction. The direction that the antenna radiates can be controlled by the sensor/switch module 1714. Operation of the sensor/switch module 1714 can select a desired direction to radiate a signal from the antenna system 1712 in response to a signal quality metric, such as received signal strength. In one embodiment, the signal metric can be communicated from the radio 1706 to the processor module 1708 and the processor module 1706 operates the sensor/switch module 1714 to select a desired direction. In another embodiment, the sensor/switch module 1714 communicates an indication of a signal metric to the processor module 1708 and the processor module operates the sensor/switch module 1714 to configure the antenna in a desired configuration.

While the description of FIG. 17 describes the sensor/switch module 1714 being located in the antenna system 1702, the sensor/switch can be in other locations, for example in the radio system. In addition, the functions performed by the sensor/switch 1714 can be performed in other modules of the overall system.

In other embodiments, the antenna systems described herein can be combined with the systems described in U.S. patent application Ser. No. 11/209,358 filed Aug. 22, 2005 titled Optimized Directional antenna System, hereby incorporated by reference in its entirety. For example, in the system depicted in FIG. 6 of that application, the above described antenna systems could be used as element 602. The same is true of element 703*a-n* of FIG. 7 and element 602 of FIG. 8. In another embodiment, the antenna systems described herein can be combined with the systems described in U.S. provisional patent application Ser. No. 60/870,818 filed Dec. 19, 2006 titled Optimized Directional MIMO Antenna System, hereby incorporated by reference in its entirety. For example, in the system depicted in FIG. 6 of that case, the above described antenna system could be used as element 602. The same is true of element 703*a-n* of FIG. 7, element 802*a-d* of FIGS. 8A and 8*b*, and element 602 of FIG. 10.

Various characteristics of the antenna have been described in embodiments herein by way of example in terms of parameters such as wavelengths and frequency. It should be appreciated that the examples provided describe aspects that appear electrically to exhibit a desired characteristic.

The above description of the disclosed embodiments is provided to enable any person skilled in the art to make or use the invention. Numerous modifications to these embodiments would be readily apparent to those skilled in the art, and the principals defined herein can be applied to other embodiments without departing from the spirit or scope of the invention. Thus, the invention is not intended to be limited to the embodiment shown herein but is to be accorded the widest scope consistent with the principal and novel features disclosed herein.

The various illustrative logical blocks, modules, and circuits described in connection with the embodiments disclosed herein can be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

The steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium. An exemplary storage medium can be coupled to the processor such the processor can read information from, and write information to, the storage medium. In the alternative, the storage medium can be integral to the processor. The processor and the storage medium can reside in an ASIC.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention:

1. A phased array antenna system for use in a wireless communication device, the antenna system comprising:

a first radiation element that is made of a material and has a length selected to resonate at a desired frequency;

a phase-shift element coupled to one end of the first radiation element; and a second radiation element coupled to the end of the phase-shift element opposite the first radiation element, so that a radio signal passes through the first radiation element through the phase-shift element and through the second radiation element, the second radiation element is made of a material and has a length selected to resonate such that the first and second radiation elements cooperate to form a desired beam pattern from the antenna system;

wherein the first radiation element, the phase-shift element, and the second radiation element lie in the same plane.

2. The antenna system of claim 1, further comprising a switch located between the first radiation element and the phase shift element, such that operation of the switch disconnects the second radiation element from the first radiation element allowing the antenna system to have two different patterns.

3. The antenna system of claim 1, wherein the first radiation element, the phase-shift element, and the second radiation element are coupled to a carrier.

4. A phased array antenna system comprising:

a lower radiating element comprising a dipole section and an H section that cooperate to form a radiating element, dipole section including a transmission path connection for coupling the dipole section to a radio;

a phase-shift element coupled to the lower radiating element; and a terminal radiating element coupled to the phase-shift element opposite to the lower radiating element, the terminal radiating element and the lower radiating element cooperate to form a desired beam pattern;

wherein the lower radiating element, the phase-shift element and the terminal radiation element are printed on a circuit board and lie in the same plane.

5. The antenna system of claim 4, further comprising a switch between the lower radiating element and the phase-shift element, operation of the switch couples and de-couples the lower radiating element to the phase-shift element and the terminal element.

6. The antenna system of claim 4, further comprising a switch in the phase-shift element, operation of the switch changes an amount of phase-shift of the phase-shift element.

7. The antenna system of claim 4, wherein the H section is coupled to a ground and the dipole section is connected to the radio.

8. The antenna system of claim 4, further comprising:

a second lower radiating element comprising a dipole section and an H section that cooperate as a radiation element;

a second phase-shift element coupled to the second lower radiating element; and a second terminal radiating element coupled to the second phase-shift element opposite to the second lower radiating element, the second terminal radiating element and the second lower radiating element cooperate to form a desired antenna pattern at a frequency that is different than the frequency of the beam pattern formed by the lower radiating element, the phase-shift element and the terminal radiating element.

9. A wireless communication device comprising:

an enclosure;

a printed circuit board comprising electronic components and a ground plane;

at least one phased array antenna system located within the enclosure, the antenna system comprising a first radiation element, a phase-shift element, and a second radiation element, wherein the first and second radiation elements are coupled to opposite ends of the phase-shift element and the first and second radiation elements cooperate to form a desired beam pattern when a radio frequency signal at a desired frequency is feed to the at least one phased antenna system;

wherein the first radiation element, the phase-shift element, and the second radiation element are printed on the printed circuit board and lie in the same plane.

10. The device of claim 9, further comprising a plurality of phased array antenna systems that are orientated in the device such that a plurality of beam patterns are formed.

11. The device of claim 10, wherein a first array antenna systems operates at a first resonant frequency and a second antenna system operates at a second resonant frequency.

12. The device of claim 9, wherein the device comprises a wireless router.

13. The device of claim 9, wherein a radio signal is feed through the first radiation element, through the phase-shift element and to the second radiation element.

14. The device of claim 9, wherein a radio signal is feed to the end of the lower radiation element coupled to the phase-shift element.

* * * * *